US005645405A

United States Patent [19]

Ota et al.

[11] Patent Number: 5,645,405

[45] Date of Patent: Jul. 8, 1997

[54] RECIPROCATING TYPE COMPRESSOR WITH MUFFLING CHAMBERS

[75] Inventors: Masaki Ota; Hisakazu Kobayashi; Soukichi Hibino; Masaya Nakamura; Yuichi Kato, all of Kariya, Japan

[73] Assignee: Kabushiki Kaisha Toyoda Jidoshokki Seisakusho, Kariya, Japan

[21] Appl. No.: 615,102

[22] Filed: Mar. 14, 1996

[30] Foreign Application Priority Data

Mar. 17, 1995 [JP] Japan ..... 7-059392

[51] Int. Cl.[6] ..... F04B 25/04

[52] U.S. Cl. ..... 417/269; 417/312; 417/542

[58] Field of Search ..... 417/269, 312, 417/542

[56] References Cited

U.S. PATENT DOCUMENTS 3,577,891 5/1971 Nemoto et al. ..... 417/312 X 5,051,069 9/1991 Ikeda et al. .

5,186,614 2/1993 Abousabha ..... 417/312

5,288,212 2/1994 Lee ..... 181/403 X 5,533,871 7/1996 Takenaka et al. ..... 417/269

FOREIGN PATENT DOCUMENTS 50-44313 5/1975 Japan .

*Primary Examiner*—Richard E. Gluck

*Attorney, Agent, or Firm*—Burgess, Ryan & Wayne

[57] ABSTRACT

A reciprocating type compressor such as a swash plate type compressor includes single headed pistons movably arranged in the cylinder bores formed in the cylinder block. The cylinder block has an extension wall laterally extending therefrom to form a first muffling chamber and the cylinder head has an extension wall laterally extending therefrom to form a second muffling chamber. A valve plate or a gasket has an extension seal portion integrally formed therewith and arranged between the extension walls of the cylinder block and the cylinder head to seal the end rims around the end openings of the first and second muffling chambers together.

6 Claims, 10 Drawing Sheets

RECIPROCATING TYPE COMPRESSOR WITH MUFFLING CHAMBERS

BACKGROUND OF THE INVENTION

1. Field of the Invention

The present invention generally relates to a compressor used in a refrigerating system and, in particular, it relates to a reciprocating type compressor having single headed pistons.

2. Description of the Related Art

In the type of compressors used in refrigerating systems for compressing a cooling gas, a muffling effect can be expected from reducing a pulsation in the pressure of a suction gas or a discharge gas. For example, a swash plate type compressor including a pulsation reduction device is disclosed in Japanese Unexamined Utility Model Publication (Kokai) No. 50-44313 and U.S. Pat. No. 5,051,069. In these prior art references, the compressor includes double headed pistons and front and rear discharge chambers arranged on the front and rear sides of the double-headed pistons. A discharge passage axially extends between the front and rear discharge chambers, and is arranged in a region of the cylinder block between the adjacent cylinder bores. This arrangement is only possible for a compressor having double headed pistons since a circumferential distance between the adjacent cylinder bores is relatively large. The pulsation reduction device can thus be relatively easily arranged near the axially central region of the compressor so that the pulsation reduction device is in fluid communication with the axially extending discharge passage.

In the case of a swash plate type or wobble plate type compressor having single headed pistons, it is usual to arrange a suction inlet and a discharge outlet in the cylinder head (rear housing), because the compression chambers are arranged on only one side of the pistons. It is necessary to increase the number of the cylinder bores compared with that of the compressor having double headed pistons in order to secure a desired discharge capacity, resulting in a region between the adjacent cylinder bores that is too narrow to provide a discharge passage between the adjacent cylinder bores. Therefore, in most prior art devices having single headed pistons, a pulsation reducing device for absorbing a pulsation in the discharge pressure is incorporated in the cylinder head. Also, there is a proposal, as shown in FIG. 10, in which a discharge muffling chamber "c" is arranged in a cylinder block "a" in communication with a discharge chamber "b", and a suction muffling chamber "f" is arranged in a cylinder head "d" in communication with a suction chamber "e".

However, the provision of the pulsation reducing device in the cylinder head results in an enlarged size of the cylinder head. In particular, in the case of a compressor equipped in an automobile, there is a severe demand for parts having lighter weight and a smaller size, and an extension of the length of the compressor is very disadvantageous. In addition, it has been recognized that the positioning of the suction and discharge ports which are connected to the refrigerating circuit is restricted to the rear of the compressor, leading to an inconvenient piping arrangement when the compressor is mounted to the automobile. In addition, in the arrangement of FIG. 10, it is necessary to provide caps $k_1$ and $k_2$ and seals $S_1$ and $S_2$ on the muffling chamber "c" and "f", respectively, resulting in an increased cost.

SUMMARY OF THE INVENTION

The object of the present invention is to solve the above described problems and to provide a reciprocating type compressor which can reduce pulsations in the pressure of a cooling gas without lengthening the compressor.

According to the present invention, there is provided a reciprocating type compressor comprising a cylinder block having an outer shell, a front end, a rear end and a plurality of cylinder bores formed therein, a housing attached to the front end of the cylinder block and having a crank chamber formed therein, a cylinder head attached to the rear end of the cylinder block via a seal means and having an outer shell, a suction chamber and a discharge chamber formed therein, single headed pistons movably arranged in the cylinder bores to form compression chambers, a drive shaft rotatably supported in the cylinder block and the housing, and a cam plate means arranged in the crank chamber and supported by the drive shaft to engage with the pistons for reciprocatingly moving the pistons. The compressor is characterized in that an extension wall laterally extends from the outer shell of the cylinder block to form a first muffling chamber, the first muffling chamber having a first end opening and a first end rim around the first end opening, an extension wall laterally extends from the outer shell of the cylinder head to form a second muffling chamber, the second muffling chamber having a second end opening and a second end rim around the second end opening, the second end opening being arranged opposite the first end opening, and an extension seal portion is integrally formed with the seal means, the extension seal portion being arranged between the extension walls of the cylinder block and the cylinder head to seal the first and second end rims together.

Therefore, it is possible to easily form axially or circumferentially arranged muffling chambers to effectively damp pulsations, without the need for a cap or a special seal. The muffling chamber formed in the extension wall on the cylinder head makes use of a space which has not been utilized in an actual design, so that a sufficient volume of the muffling chamber is ensured without a substantial increase in the length of the compressor.

Preferably, the seal means comprises a valve plate and seal members arranged on either side of the valve plate, the extension seal portion separating the first and second muffling chambers one from the other, one of the first and second muffling chambers being in communication with the suction chamber and the other of the first and second muffling chambers being in communication with the discharge chamber.

Preferably, the extension walls include longitudinally extending separating walls aligned with each other and the extension seal portion includes a seal wall portion overlapping the separating walls, whereby each of the first and second muffling chambers is divided into first and second sub-chambers so that the first sub-chamber of the first muffling chamber is continuous to the first sub-chamber of the second muffling chamber and the second sub-chamber of the first muffling chamber is continuous to the second sub-chamber of the second muffling, one of the first and second sub-chambers being in communication with the suction chamber and the other of the first and second sub-chambers being in communication with the discharge chamber.

Preferably, the first and second muffling chambers are in communication with each other via an opening in the extension seal portion, the merged muffling chambers being in communication with the suction chamber.

Preferably, the first and second muffling chambers are in communication with each other via an opening in the extension seal portion, the merged muffling chambers being in communication with the discharge chamber.

Preferably, the compressor further comprises an extension wall laterally extending from the housing, the first muffling chamber being continuously formed by the extension wall of the housing and the extension wall of the cylinder block.

BRIEF DESCRIPTION OF THE DRAWINGS

The present invention will become more apparent from the following description of the preferred embodiments, with reference to the accompanying drawings, in which:

FIG. 1(*a*) is a cross sectional view of the valve plate 4;

DESCRIPTION OF THE PREFERRED EMBODIMENTS

Figures 1, 1A:
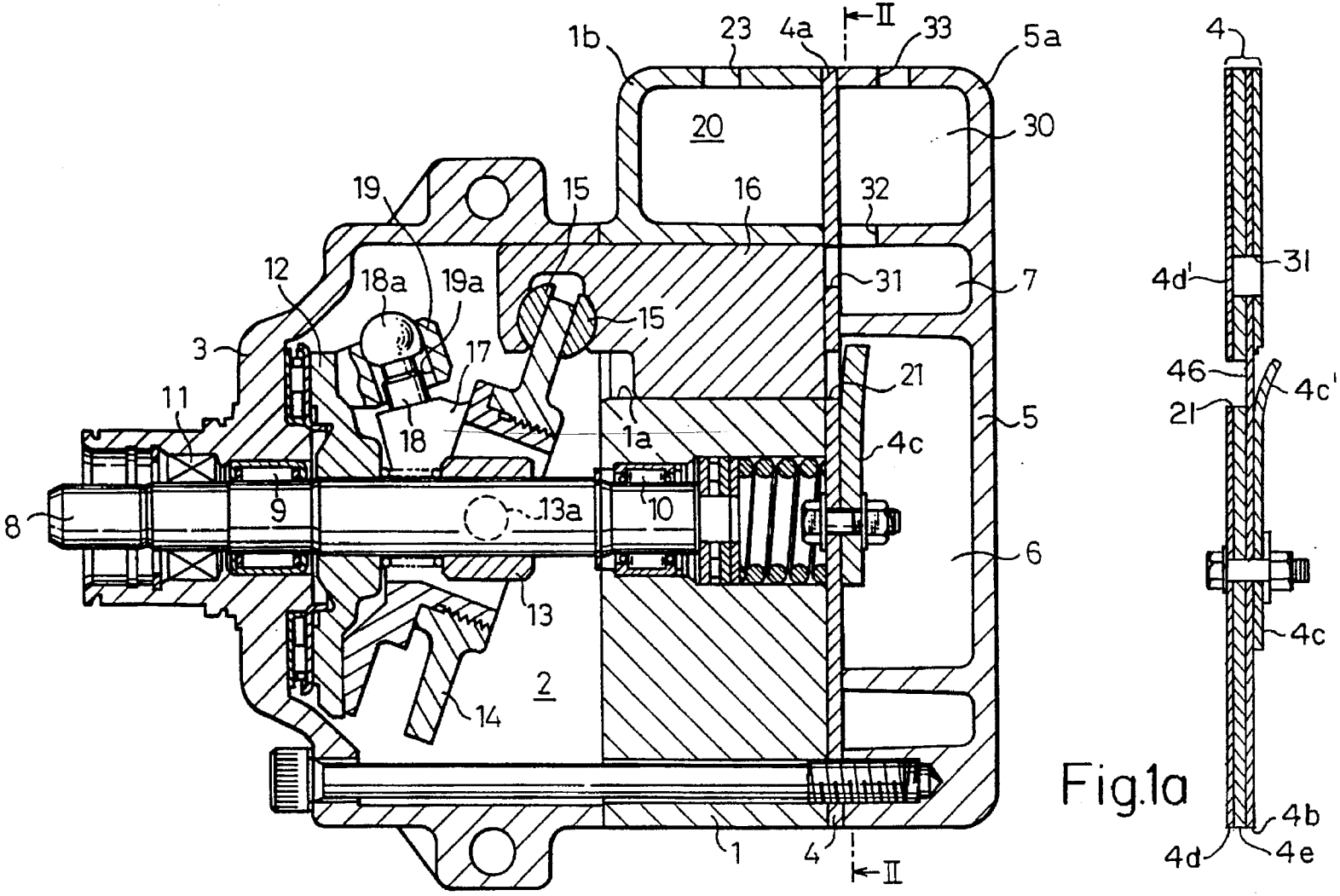
FIG. 1 is a cross-sectional view of a reciprocating type compressor according to the first embodiment of the present invention.
Figure 2:
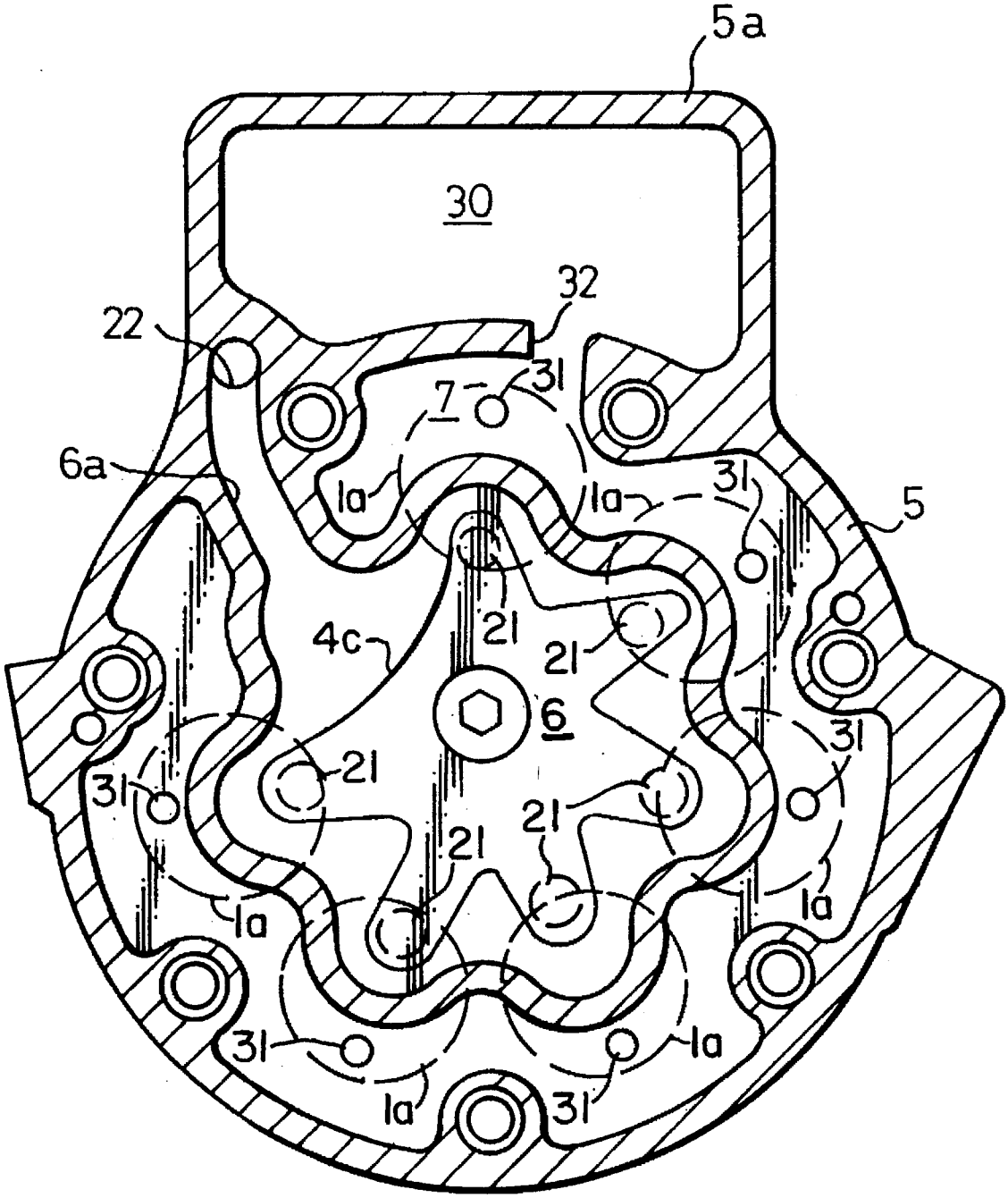
FIG. 2 is a cross-sectional view of the compressor of FIG. 1, taken along the line II—II in FIG. 1 showing arrangement of cylinder bores and valves.

FIGS. 1 and 2 show a reciprocating type compressor according to the first embodiment of the present invention. The compressor includes a cylinder block 1 having at least five parallel cylinder bores 1*a* (six cylinder bores shown in FIG. 2), a housing 3 attached to the front end of the cylinder block 1 and having a crank chamber 2 formed therein, and a cylinder head 5 attached to the rear end of the cylinder block 1 via a valve plate 4. The valve plate 4 has discharge ports 21 and suction ports 31, discharge valve plate 4*b* having discharge valves 4*b*, discharge valve protector plate 4*c*, suction valve 4*d'* and base plate 4*e*. Discharge reed valves and suction reed valves are arranged on the discharge ports 21 and the suction ports 31. The cylinder head 5 forms a discharge chamber 6 in the inner region in the cylinder head 5 and a suction chamber 7 in the outer region in the cylinder head 5. By arranging the discharge chamber 6 in the inner region in the cylinder head 5, it is possible to form the discharge reed valves in an integral valve structure having radially extending reeds.

A drive shaft 8 is arranged in the housing 3 and the cylinder block 1 and rotatably supported by radial bearings 9 and 10, and a shaft seal device 11 is arranged between the drive shaft 8 and the housing 3. A lug plate 12 is attached to the drive shaft 8 in the crank chamber 2 for rotation therewith, and a sleeve 13 is slidably fitted on the drive shaft 8. The sleeve 13 has pivot pins 13*a* arranged on a line passing through a diameter of the sleeve 13 and extending outwardly from the sleeve 13. A swash plate 14 consisting of parts fixed together by threads has engaging holes into which the pivot pins 13*a* are fitted, so that the swash plate 14 is tiltably supported by the drive shaft 8. Pairs of semi-spherical shoes 15 are arranged on the effective sliding surfaces of the swash plate 14 for sliding contact therewith. Single headed pistons 16 are slidably inserted in the cylinder bores 1*a* and engage with the semi-spherical shoes 15 in a spherical contact therewith, whereby the single headed pistons 16 are anchored to the swash plate 14.

The swash plate 14 is connected to the lug plate 12 by a hinge mechanism. The hinge mechanism includes a pair of brackets 17 extending from the front side of the swash plate 14 and arranged on either side of top dead center of the swash plate 14. Each bracket 17 has a guide pin 18 having a rounded head portion 18*a*. The hinge mechanism also includes a pair of support arms 19 extending from the rear side of the lug plate 12. Each support arm 19 has a circular hole 19*a* in which the rounded head portion 18*a* of the guide pin 18 is inserted. The movement of the swash plate 14 is thus controlled by the hinge mechanism. The inclination of the circular hole 19*a* is determined so that the top positions of the single headed pistons 16 are always stably located.

As a characteristic feature of the present invention, the cylinder block has an extension wall 1*b* laterally extending from the outer shell thereof to form a discharge muffling chamber 20 having an end opening on the side of the cylinder head 5. The cylinder head 5 has an extension wall 5*a* laterally extending from the outer shell thereof to form a suction muffling chamber 30 having an end opening arranged in an opposite relationship with the end opening of the discharge muffling chamber 20.

The valve plate 4 has an extension seal portion 4*a* integrally formed with the valve plate 4, the extension seal portion 4*a* being arranged between the extension wall 1*b* of the cylinder block 1 and the extension wall 5*a* of the cylinder head 5 to seal the end rims around the end openings of the extension walls 1*b* and 5*a* together. In this embodiment, the extension seal portion 4*a* has no openings and separates the discharge muffling chamber 20 and the suction muffling chamber 30 from each other. A further seal member such as a gasket (not shown) is arranged between the valve plate 4 and the cylinder block 1, and between the valve plate 4 and the cylinder head 5. Such a seal member also has an extension corresponding to the extension seal portion 4*a*. Therefore, it should be noted that the term "seal means" in the appended claims means the combination of the valve plate 4 and the gasket or any other seal member. The valve plate 4 shown in FIGS. 3, 5 and 8 has a structure similar to that shown for valve plate 4 in FIGS. 1 and 2.

As can be seen in FIGS. 1 and 2, the discharge chamber 6 includes a channel 6*a* which extends outwardly from the central region to the outer region of the cylinder head 5 but which is separated from the suction chamber 7. A through hole 22 is provided in the extension seal portion 4*a* at a position of the end of the channel 6*a*, so that the discharge muffling chamber 20 is in communication with the discharge chamber 6. The suction muffling chamber 30 is in communication with the suction chamber 7 via a channel 32 provided in the outer shell wall of the cylinder head 5. The discharge chamber 6 has a discharge port 23, and the suction chamber 7 has a suction port 33, for interconnecting these chambers to an external refrigerating circuit.

When the compressor is driven, the rotational movement of the drive shaft 8 is converted to the rotational and swinging movement of the swash plate 14 through the lug plate 12 and the sleeve 13, and the single headed pistons 16 are reciprocatingly moved in the cylinder bores 1*a* to suck a cooling gas from the suction chamber 7 into the cylinder bores 1*a*, to compress the cooling gas, and to discharge the compressed cooling gas to the discharge chamber 6. The tilting angle of the swash plate 14 and the stroke of the single headed pistons 16 change depending on the difference between the pressure in the crank chamber 2 and the pressure in the suction chamber 7, to thereby control a discharge capacity. The pressure in the crank chamber 2 can be controlled by a control valve (not shown) depending a thermal load of the refrigerating circuit.

The suction muffling chamber 30 provides sufficient volume between the suction chamber 7 and the suction port 33 connected to the external refrigerating circuit, and accordingly, pulsations in a suction gas pressure occurring due to an opening and closing operation of the suction valves and pulsations having a high frequency component caused by vibration of the suction valves are effectively absorbed by an expansion type damping function of the suction muffling chamber 30.

Also, the high pressure cooling gas discharged from the cylinder bore la to the discharge chamber 6 is introduced into the discharge muffling chamber 20 having sufficient volume via the channel 6*a* and the through hole 22, and the cooling gas is delivered to the external refrigerating circuit via the discharge port 23 after pulsations in the discharged gas pressure are absorbed by an expansion type damping function of the discharge muffling chamber 20. In this way, the discharge port 23 and the suction port 33, which are connected to the external refrigerating circuit, can be arranged in the extension walls 1*b* and 5*a* laterally extending from the cylinder block 1 and the cylinder head 5, and this arrangement provides a large freedom in a design of a piping arrangement when the compressor is mounted to an automobile.

Figure 3:
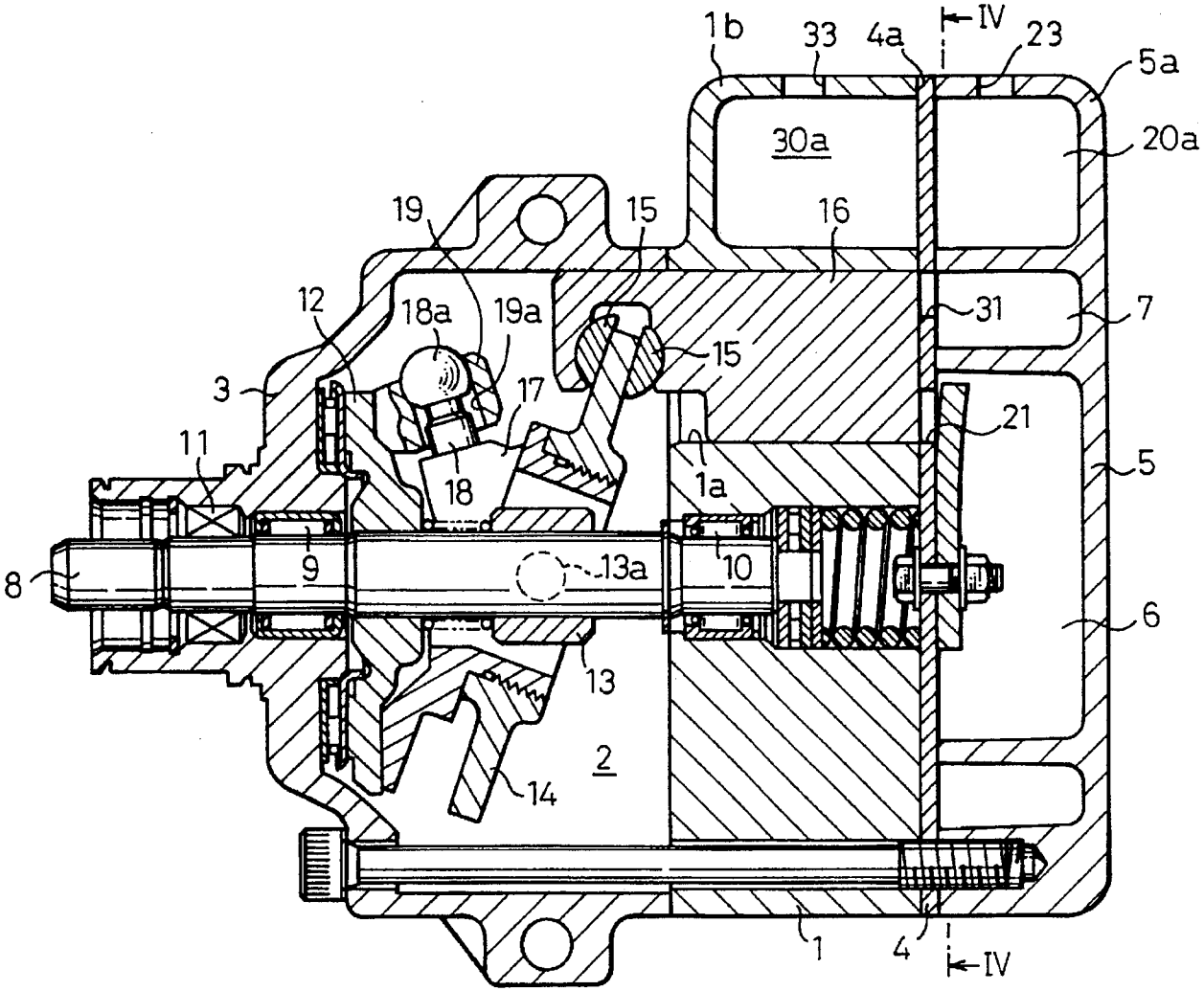
FIG. 3 is a cross-sectional view of a reciprocating type compressor according to the second embodiment of the present invention.
Figure 4:
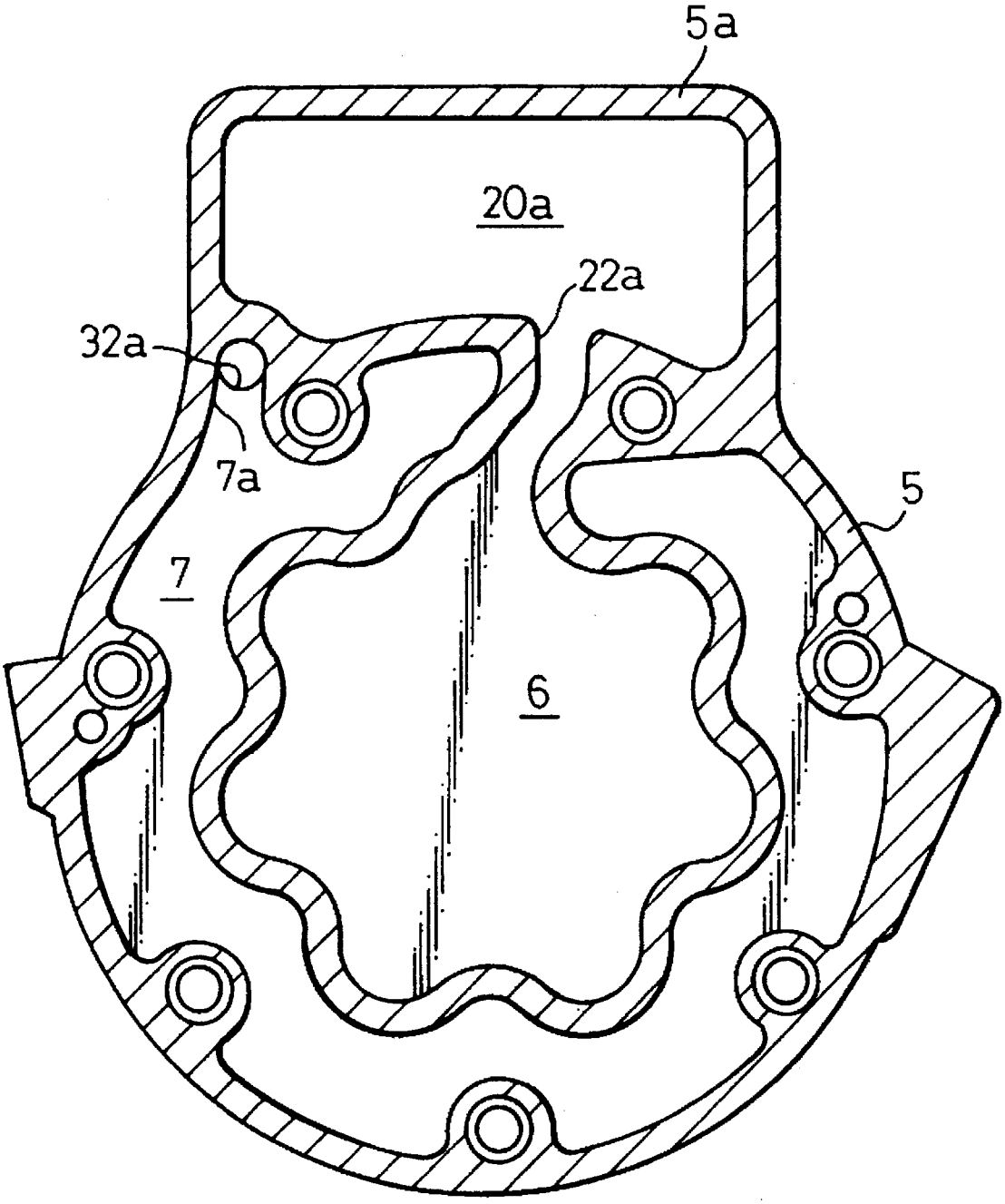
FIG. 4 is a cross-sectional view of the compressor of FIG. 3, taken along the line IV—IV in FIG. 3.

FIGS. 3 and 4 show a reciprocating type compressor according to the second embodiment of the present invention. The compressor in this embodiment is similar to the compressor of the first embodiment except that the discharge muffling chamber 20*a* and the suction muffling chamber 30*a* are arranged opposite to those of the first embodiment. That is, the suction muffling chamber 30*a* is formed in the extension wall 1*b* laterally extending from the outer shell of cylinder block 1 and the discharge muffling chamber 20*a* is formed in the extension wall 5*a* laterally extending from the outer shell of the cylinder head 5. Therefore, the suction chamber 7 includes a channel 7*a* which extends outwardly to the outer region of the cylinder head 5, and a through hole 32*a* is provided in the extension seal portion 4*a* at a position corresponding to the end of the channel 7*a*, so that the suction muffling chamber 30*a* is in communication with the suction chamber 7. The discharge muffling chamber 20*a* is in communication with the discharge chamber 6 via a channel 22*a* provided in the outer shell wall of the cylinder head 5 so as to intercept the suction chamber 7. Also, the discharge port 23 and the suction port 33 are formed in the discharge chamber 6 and the suction chamber 7 for interconnecting these chambers to the external refrigerating circuit. In this way, it is possible to select one of the arrangements of the first and second embodiments so that muffling chambers 20, 30, 20*a*, and 30*a* are best matched with the arrangement of other components.

Figure 5:
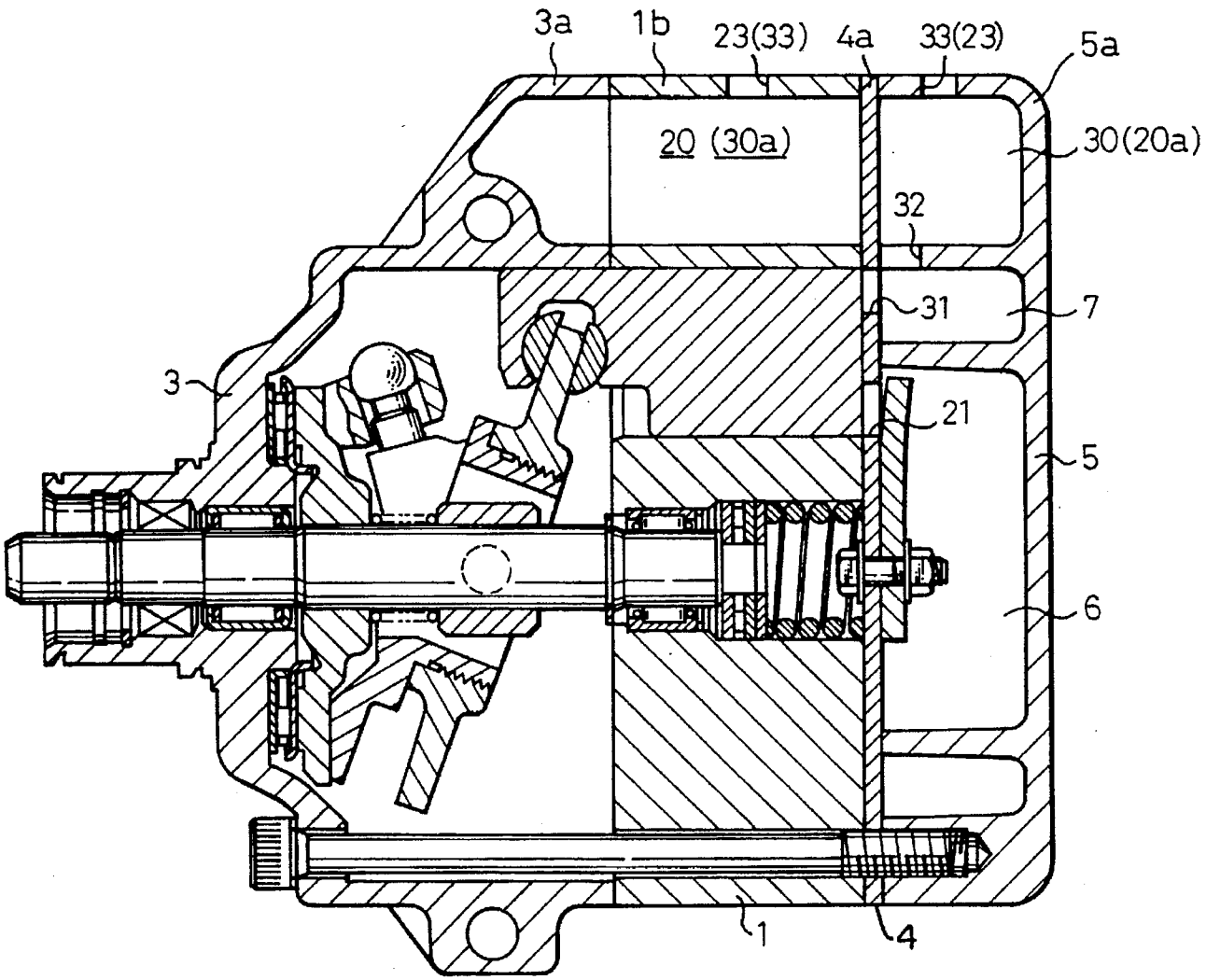
FIG. 5 is a cross-sectional view of a reciprocating type compressor according to the third embodiment of the present invention.

FIG. 5 shows the third embodiment of the present invention. In this embodiment, an extension wall 3*a* is further provided in addition to the extension walls 1*b* and 5*a*, the extension wall 3*a* laterally extending from the housing 3. The suction or discharge muffling chamber 20 or 30*a* is continuously formed by the extension wall 3*a* of the housing 3 and the extension wall 1*b* of the cylinder block 1. Therefore, it is possible to increase the volume of the suction or discharge muffling chamber 20 or 30*a*.

Figure 6:
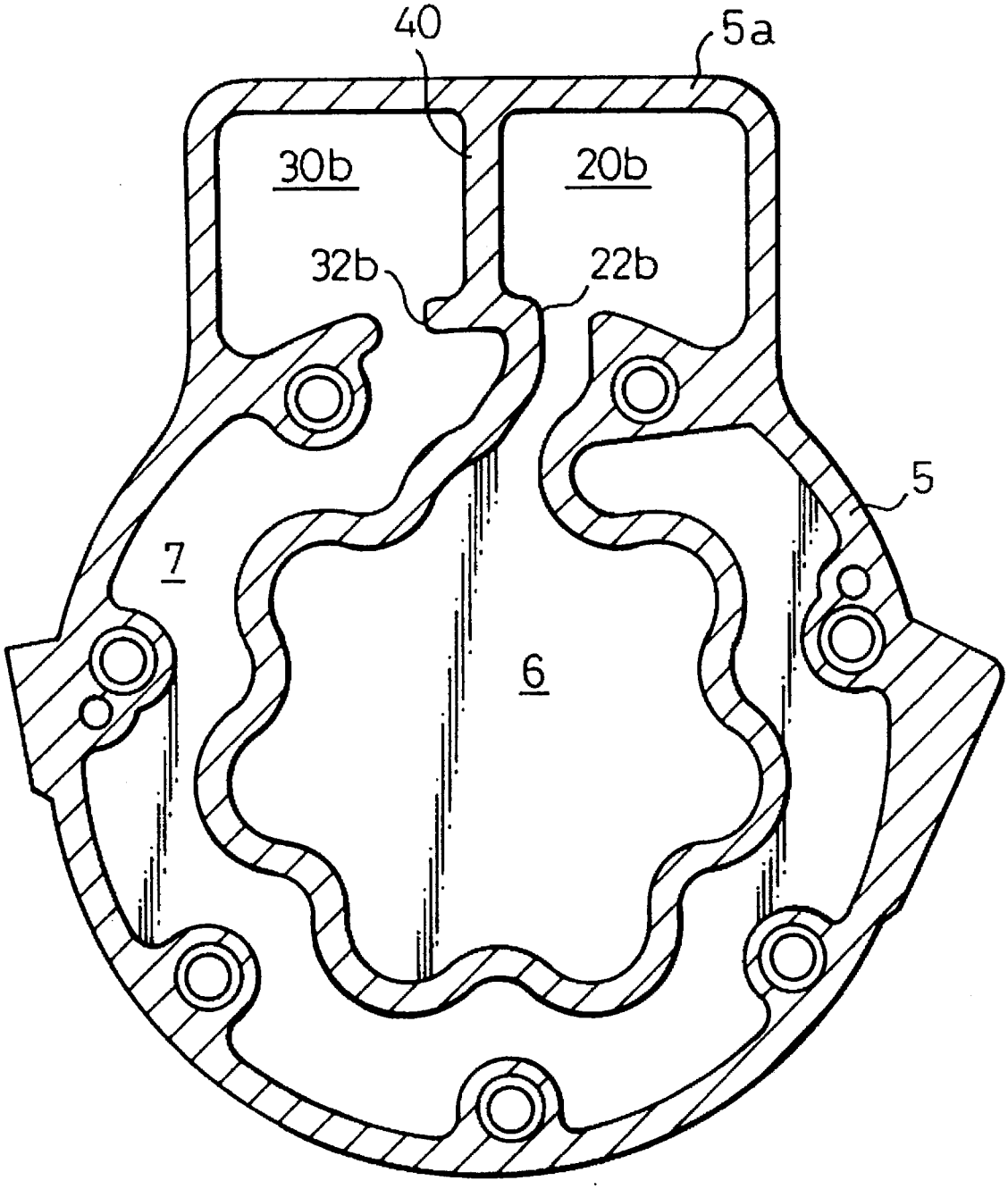
FIG. 6 is a cross-sectional view of a reciprocating type compressor according to the fourth embodiment of the present invention.
Figure 7:
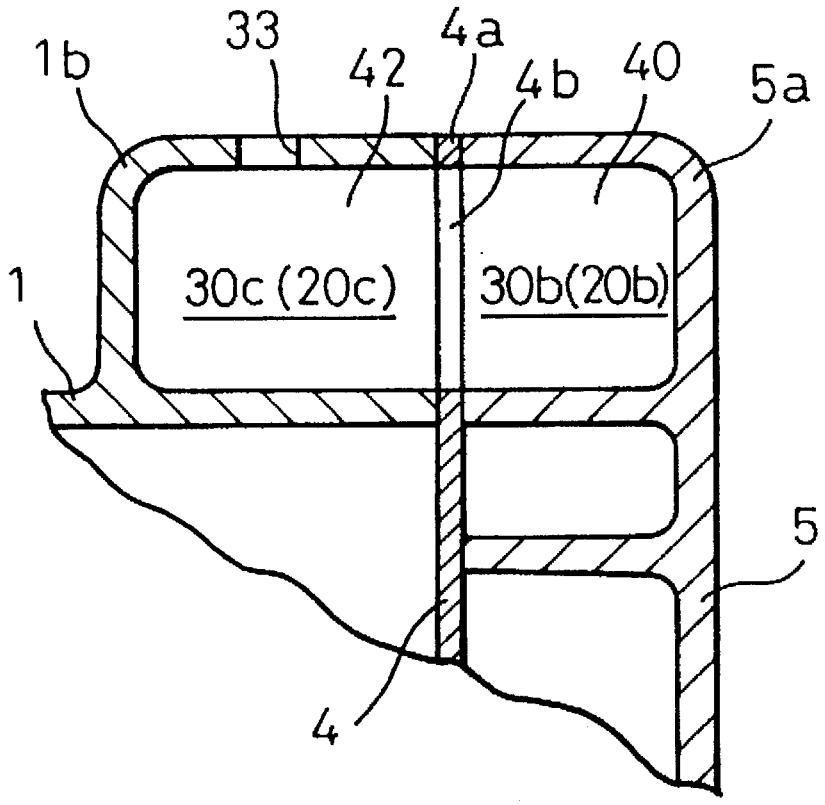
FIG. 7 is a cross-sectional view of the compressor of FIG. 6.

FIGS. 6 and 7 show the fourth embodiment of the present invention. In this embodiment, the extension wall 5*a* of the cylinder head 5 includes a longitudinally extending separating wall 40 which divides the muffling chamber in the extension wall 5*a* into first and second sub-chambers 20*b* and 30*b*. The extension wall 1*b* also includes a longitudinally extending separating wall 42 aligned with the separating wall 40, which also divides the muffling chamber in the extension wall 1*b* into first and second sub-chambers 20*c* and 30*c*. The extension seal portion 4*a* includes a seal wall portion overlapping the separating walls 40 and 42 and openings 4*b* by which the first sub-chamber 20*b* is continuous with the first sub-chamber 20*c* and the second sub-chamber 30*b* is continuous with the second sub-chamber 30*c*. The first sub-chamber 20*b* is connected to the discharge chamber 6 via a channel 22*b* and the second sub-chamber 30*b* is connected to the suction chamber 7 via a channel 32*b*. In this way, it is possible to symmetrically arrange the discharge port 23 and the suction port 33 in the extension wall 1*b* or 5*a* on either side of a plane parallel to the axis of the cylinder block 1, so a large freedom in a design of a piping arrangement is ensured when the compressor is mounted to an automobile.

Figure 8:
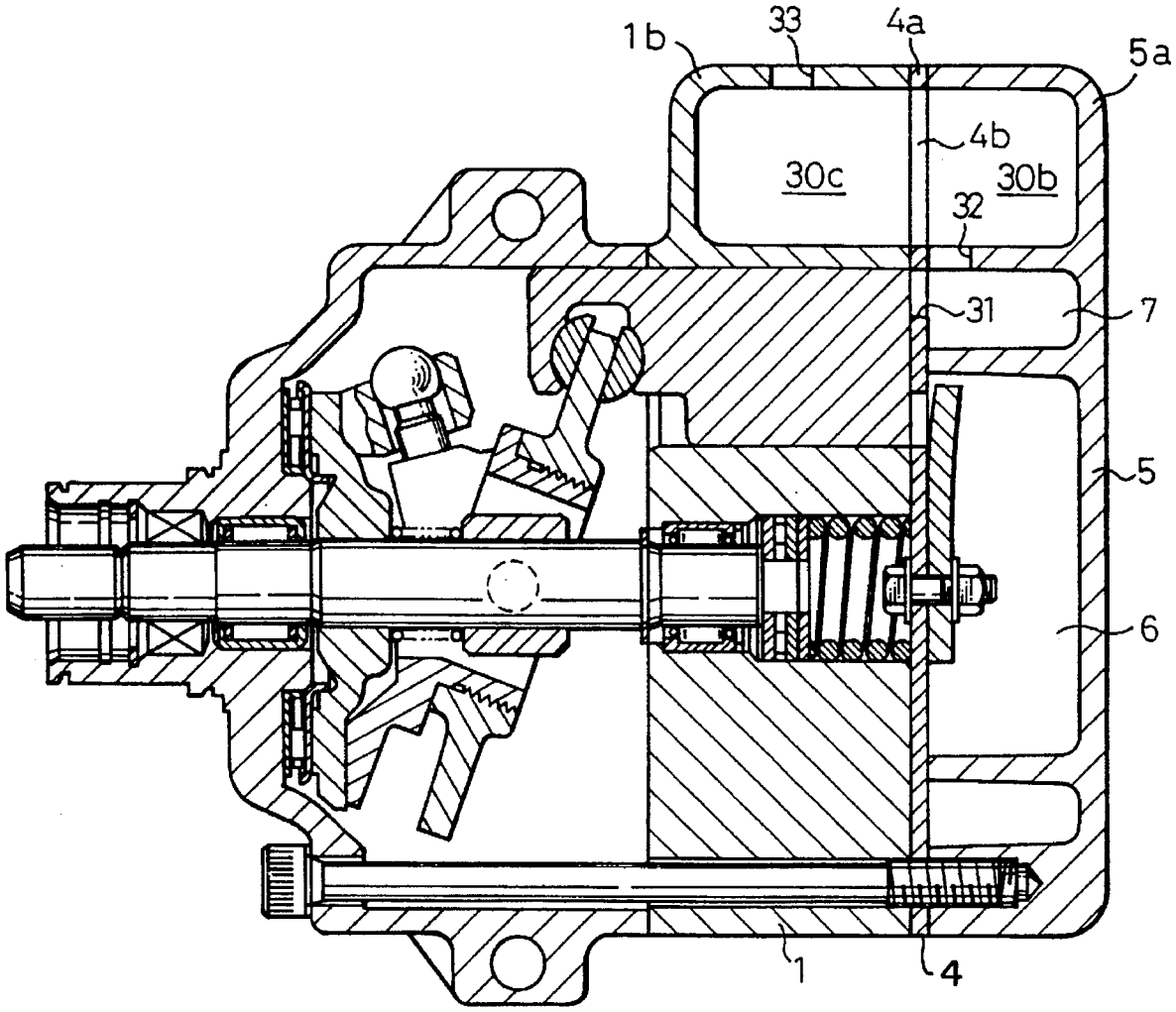
FIG. 8 is a cross-sectional view of a reciprocating type compressor according to the fifth embodiment of the present invention.
Figure 9:
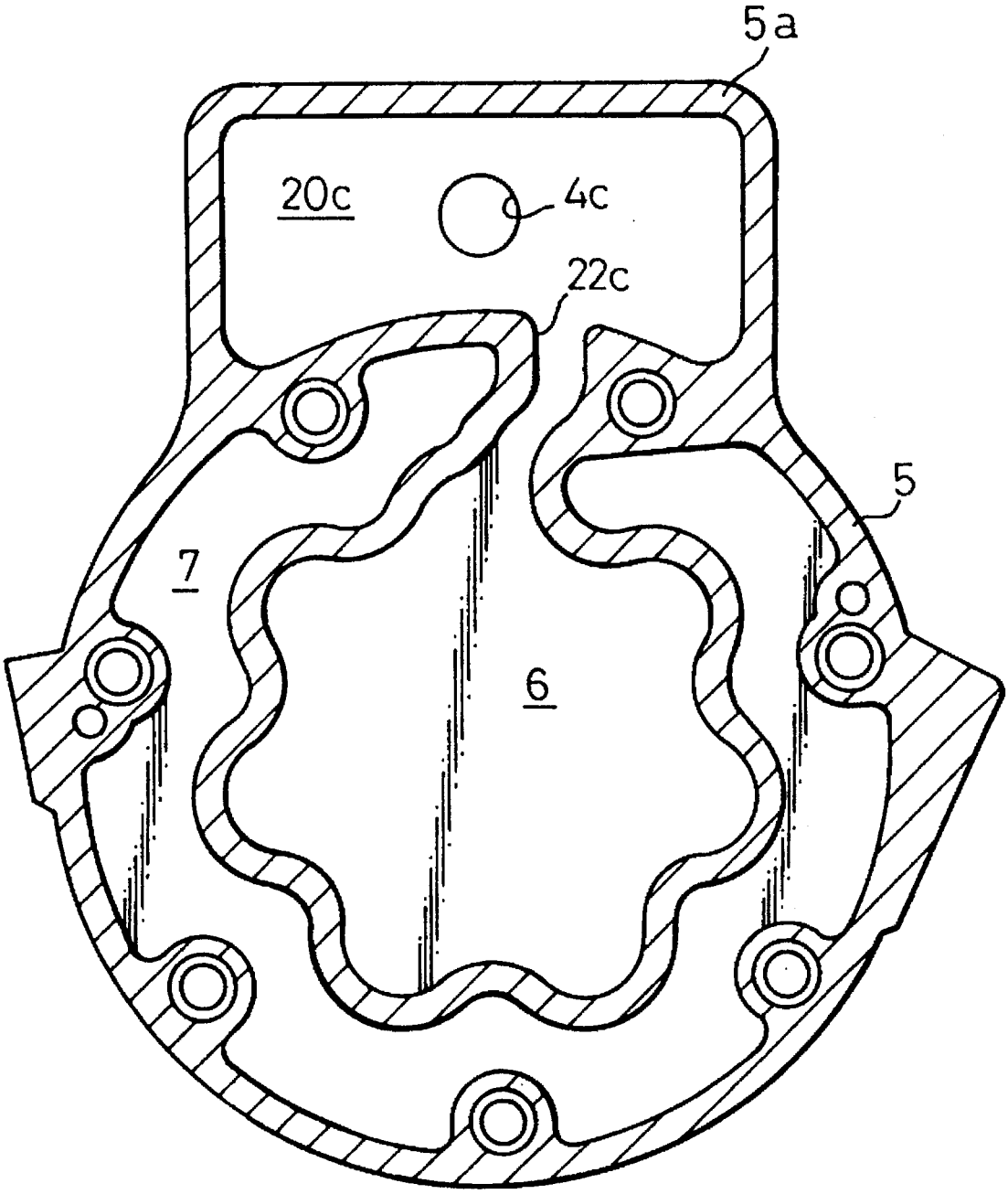
FIG. 9 is a cross-sectional view of a reciprocating type compressor according to the sixth embodiment of the present invention.
Figure 10:
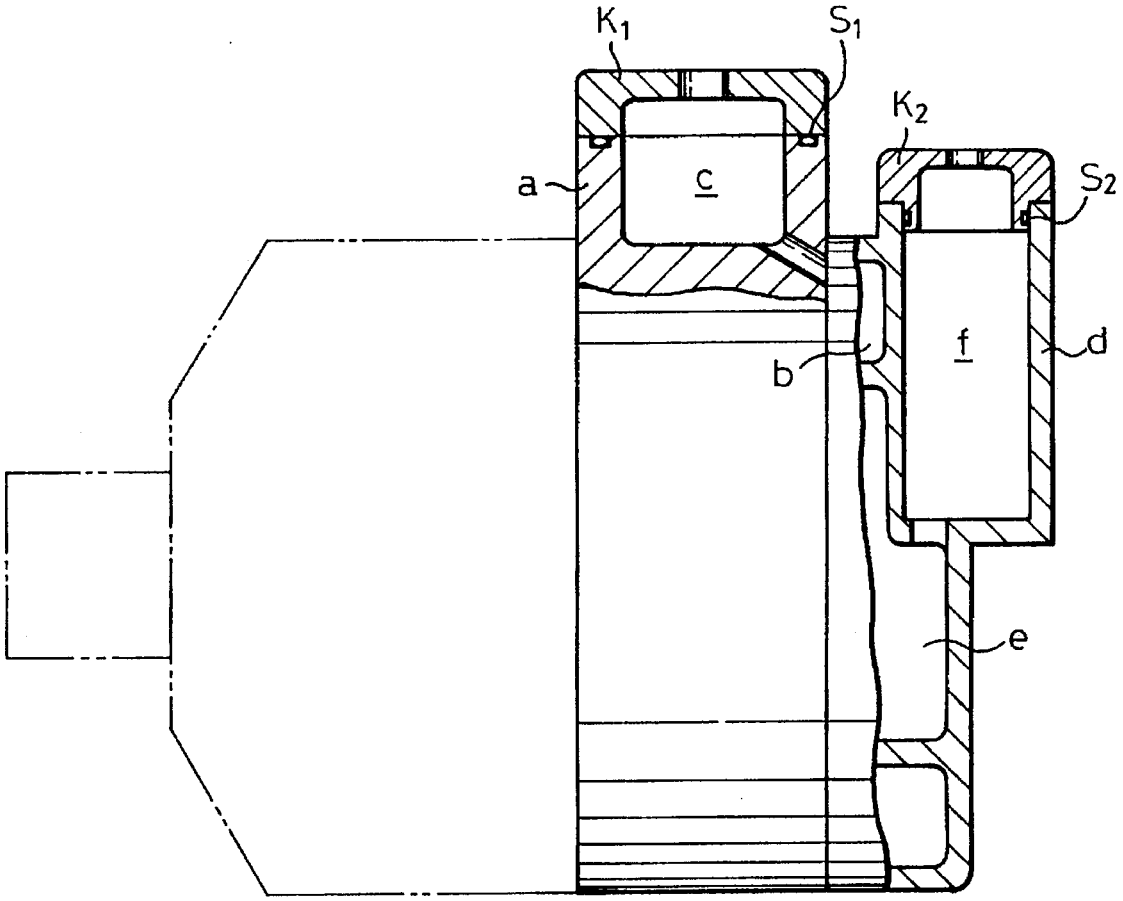
Fig.10 PRIOR ART
FIG. 10 is a cross-sectional view of a compressor of a prior art.

FIGS. 8 and 9 show the fifth and sixth embodiments of the present invention. In FIG. 8, the extension walls 1*b* and 5*a* form the muffling chambers 30*b* and 30*c*, and the extension seal portion 4*a* includes a seal wall portion overlapping the extension walls 1*b* and 5*a* and an opening 4*b* having a cross section corresponding to that the muffling chambers 30*b* and 30*c*, by which the muffling chambers 30*b* and 30*c* are continuous with each other to thereby form a single large suction muffling chamber. The suction muffling chamber 30*b*–30*c* is connected to the suction chamber 7 via the channel 32, and to the outer refrigerating circuit via the suction port 33.

In FIG. 9, the extension seal portion 4*a* includes a relatively small circular opening 4*c* by which the muffling chambers 20*b* and 20*c* formed in the extension walls 1*b* and 5*a* communicate with each other to thereby form a single larger discharge muffling chamber. The discharge muffling chamber 20*b*–20*c* is connected to the discharge chamber 6 via the channel 22*c*, and to the outer refrigerating circuit via the suction port 23, which may be provided at the position of the suction port 33 of FIG. 8. The circular opening 4*c* of the extension seal portion 4*a* serves as a restriction between the muffling chamber 20*b* and 20*c*, and this is advantageous in assisting the expansion type damping function. However, when the suction port 23 is provided in the extension wall 5*a* of the cylinder head 5 according to requirements of the piping, it is preferable that the opening in the extension seal portion 4*a* may have a cross section corresponding to the muffling chambers 20*b* and 20*c*, to realize a large volume of the muffling chambers 20*b* and 20*c*.

In the fourth to sixth embodiments, it is possible to form the valve plate 4 integrally with the cylinder block 1, and to arrange a gasket as a seal means between the outer end face of the cylinder block 1 substantially forming a top wall of the cylinder bores 1*a* and the cylinder head 5. In this case, it is possible that the gasket has an extension seal portion integrally extending therefrom, the extension seal portion being arranged between the cylinder block 1 and the cylinder head 5 to seal the end rims around the end openings of the extension walls 1*b* and 5*a* together. In this case, a suction system may be changed, and it is possible to arrange a rotary suction valve mounted to the rear portion of the drive shaft for rotation therewith to introduce a cooling gas into the cylinder bores 1*a*.

As explained in greater detail, the present invention provides for a reciprocating type compressor characterized in that the cylinder block having an extension wall laterally extending from the outer shell thereof to form a first muffling chamber, the first muffling chamber having a first end opening and a first end rim around the first end opening, the cylinder head having an extension wall laterally extending from the outer shell thereof to form a second muffling chamber, the second muffling chamber having a second end opening and a second end rim around the second end opening, the second end opening being arranged opposite the first end opening, and the seal means having an extension seal portion integrally formed with the seal means, the extension seal portion being arranged between the extension walls of the cylinder block and the cylinder head to seal the first and second end rims together. Therefore, it is possible to easily form a single large muffling chamber, or axially or circumferentially arranged muffling chambers to effectively damp pulsations, without the need for a cap or a special seal. In particular, the provision of the muffling chamber in the extension wall on the cylinder head is advantageous in securing a sufficient volume of the muffling chamber without a substantial increase in the length of the compressor, and it is possible to arrange a suction port and a discharge port in a variety of desirable dispositions, so a large freedom in a design of a piping arrangement for connection to an external refrigerating circuit is ensured when the compressor is mounted to an automobile.

We claim:

1. A reciprocating type compressor comprising:

a cylinder block having an outer shell, a front end, a rear end and a plurality of cylinder bores formed therein;

a housing attached to the front end of the cylinder block and having a crank chamber formed therein;

a cylinder head attached to the rear end of the cylinder block via a seal means and having an outer shell, a suction chamber and a discharge chamber formed therein;

single headed pistons movably arranged in the cylinder bores to form compression chambers, the compression chambers are in fluid communication with the suction chamber and the discharge chamber by valve means;

a drive shaft rotatably arranged in the cylinder block and the housing;

a cam plate means arranged in the crank chamber and supported by the drive shaft to engage with the pistons for reciprocatingly moving the pistons;

an integral wall laterally extending from the outer shell of the cylinder block to form a first muffling chamber, the first muffling chamber having a first end opening and a first end rim around the first end opening;

an integral extension wall laterally extending from the outer shell of the cylinder head to form a second muffling chamber, the second muffling chamber having a second end opening and a second end rim around the second end opening, the second end opening being arranged opposite the first end opening; one of the first and second muffling chambers being connected to the suction chamber by a restricted passage and the other of the first and second muffling chambers being connected to the discharge chamber by a restricted passage; and an extension seal portion integrally formed with the seal means, the extension seal portion being arranged between the extension walls of the cylinder block and the cylinder head to seal the first and second end rims together.

2. A reciprocating type compressor according to claim 1, wherein the seal means comprises a valve plate and seal members arranged on either side of the valve plate, the extension seal portion separating the first and second muffling chambers one from the other.

3. A reciprocating type compressor according to claim 1, wherein the extension walls include longitudinally extending separating walls aligned with each other and the extension seal portion includes a seal wall portion overlapping the separating walls, whereby each of the first and second muffling chambers is divided into first and second sub-chambers so that the first sub-chamber of the first muffling chamber is continuous to the first sub-chamber of the second muffling chamber and the second sub-chamber of the first muffling chamber is continuous to the second sub-chamber of the second muffling chamber, one of the first and second sub-chambers being in communication with the suction chamber and the other of the first and second sub-chambers being in communication with the discharge chamber.

4. A reciprocating type compressor according to claim 1, wherein the first and second muffling chambers are in communication with each other via an opening in the extension seal portion, the merged muffling chambers being in communication with the suction chamber.

5. A reciprocating type compressor according to claim 1, wherein the first and second muffling chambers are in communication with each other via an opening in the extension seal portion, the merged muffling chambers being in communication with the discharge chamber.

6. A reciprocating type compressor according to claim 1, further comprising an extension wall laterally extending from the housing, the first muffling chamber being continuously formed by the extension wall of the housing and the extension wall of the cylinder block.

* * * * *